US008661963B2

(12) United States Patent
Patel

(10) Patent No.: US 8,661,963 B2
(45) Date of Patent: Mar. 4, 2014

(54) RECOIL SYSTEM AND METHOD FOR UPPER RECEIVER

(76) Inventor: Swetal K. Patel, Dallas, GA (US)

( * ) Notice: Subject to any disclaimer, the term of this patent is extended or adjusted under 35 U.S.C. 154(b) by 0 days.

(21) Appl. No.: 13/330,826

(22) Filed: Dec. 20, 2011

(65) Prior Publication Data

US 2012/0204713 A1 Aug. 16, 2012

Related U.S. Application Data

(60) Provisional application No. 61/441,688, filed on Feb. 11, 2011.

(51) Int. Cl.
*F41A 3/82* (2006.01)
*F41A 3/66* (2006.01)

(52) U.S. Cl.
USPC ..... 89/199; 42/16

(58) Field of Classification Search
USPC ..... 42/5, 16, 71.01, 74; 89/198, 199
See application file for complete search history.

(56) References Cited

U.S. PATENT DOCUMENTS

| | | | | | |
|---|---|---|---|---|---|
| 2,951,424 | A | | 9/1960 | Stoner | |
| 3,198,076 | A | * | 8/1965 | Stoner | 89/128 |
| 3,318,192 | A | * | 5/1967 | Miller et al. | 89/142 |
| 3,618,457 | A | * | 11/1971 | Miller | 89/185 |
| 3,771,415 | A | | 11/1973 | Into et al. | |
| 3,776,095 | A | * | 12/1973 | Atchisson | 89/128 |
| 4,008,537 | A | * | 2/1977 | Elbe | 42/16 |
| 4,058,922 | A | * | 11/1977 | Elbe et al. | 42/16 |
| 4,142,314 | A | | 3/1979 | Foote | |
| 4,416,186 | A | * | 11/1983 | Sullivan | 89/198 |
| 4,910,904 | A | | 3/1990 | Rose | |
| 4,938,116 | A | | 7/1990 | Royster | |
| 5,272,956 | A | | 12/1993 | Hudson et al. | |
| 6,418,833 | B1 | | 7/2002 | Hajjar | |
| 6,732,466 | B2 | | 5/2004 | Bentley | |
| 6,848,351 | B1 | * | 2/2005 | Davies | 89/191.01 |
| 6,931,978 | B1 | * | 8/2005 | Dionne | 89/194 |
| 7,261,029 | B1 | * | 8/2007 | Davis | 89/148 |
| 7,340,857 | B1 | | 3/2008 | Bentley | |
| 7,770,318 | B2 | | 8/2010 | Bentley | |
| 2005/0262752 | A1 | * | 12/2005 | Robinson et al. | 42/71.01 |
| 2007/0214697 | A1 | | 9/2007 | Ochoa | |

FOREIGN PATENT DOCUMENTS

WO PCT/US88/03813 5/1989

* cited by examiner

*Primary Examiner* — Bret Hayes
(74) *Attorney, Agent, or Firm* — Thomas | Horstemeyer, LLP

(57) ABSTRACT

In embodiments, a modular rifle includes a lower receiver assembly, an upper receiver assembly, and a coupling mechanism. The upper receiver contains a bolt carrier and a housing enclosing the recoil spring and rod. Within the housing is a counter bore shoulder against which the recoil spring rests. Integrated into the top face of the bolt carrier are compartments, upon which the housing is mounted. Holes in the front of the housing and the upper receiver assembly accommodate the rod. Containing the recoil spring and rod within in the housing mounted to the bolt carrier allows the modular rifle to have a folding, collapsible, or otherwise non-fixed stock. Attached to the rod is a retaining tab, the depression of which allows for the release of the upper receiver from the lower receiver for disassembly of the rifle.

10 Claims, 4 Drawing Sheets

RECOIL SYSTEM AND METHOD FOR UPPER RECEIVER

PRIORITY

This application claims priority from the provisional application filed Feb. 11, 2011, with Ser. No. 61/441,688 and entitled "Recoil System and Method for Upper Receiver," which is incorporated herein by reference in its entirety.

BACKGROUND OF THE INVENTION

The M16-style rifle is a type of modular rifle system commonly used by military and police forces that features a gas-operated bolt and bolt carrier system, as disclosed, for example, in U.S. Pat. No. 2,951,424, issued to Eugene M. Stoner on Sep. 6, 1960 (incorporated herein by reference in its entirety). A modular rifle typically includes a lower receiver assembly, and upper receiver assembly, and a coupling mechanism. Two types of M-16-style rifle are the M16/M4 rifle system in 5.56 mm/.223 caliber and the AR10/SR25 rifle system in 7.62 mm/.308 caliber. The M16/M4 rifle system in 5.56 mm/.223 caliber and the AR10/SR25 rifle system in 7.62 mm/.308 caliber each utilize direct gas operation with a traditional, non-folding butt stock. The current designs of the M16/M4 and AR10/SR25 rifle systems contain a recoil spring and buffer assembly, which allows the bolt carrier to cycle when the rifle is being fired. These recoil springs and buffer assemblies are typically contained with the rifle in the same center line as the barrel, requiring the traditional fixed stock in order to contain the spring and buffer assembly and allow for compression of the spring and cycling of the bolt carrier. Relocating the recoil spring and rod outside of the center line of the barrel allows for the M16-style rifle to have a folding or non-fixed stock. Containing the relocated recoil spring and rod within a housing further prevents the detrimental effects of heat transfer from the direct gas operation.

SUMMARY

In embodiments, this new system and method would allow for the M16/M4 rifle system in 5.56 mm/.223 caliber and the AR10/SR25 rifle system in 7.62 mm/.308 caliber, among other possible rifle systems, to have a folding stock capability. There have been previous folding stock rifle designs, but such designs used a recoil spring housed around the gas tube, which allows heat transfer from the gas tube to the spring and causes weakening of the spring. In embodiments, this new system and method uses a recoil spring and rod housed inside the upper receiver sitting above the bolt carrier. The recoil spring/rod is contained in a housing that sits on top of the bolt carrier. This housing is designed in such a way that it not only still allows the use of direct gas impingement design of the M16-style rifle but also prevents transfer of heat from the gas tube to the recoil spring.

In embodiments, the system and method comprise a bolt carrier containing machined compartments cut on the top of the carrier that allow for the housing to sit on the carrier inside the upper receiver. The upper receiver's inside profile matches the outside profile of the bolt carrier and spring housing. The housing contains a counter bore shoulder against which the spring rests, and the rod protrudes through a hole in the front of the housing and a hole in the upper receiver. This allows for the bolt carrier to have forward tension from the recoil spring.

In embodiments, the system and method comprise a spring rod with a retaining tab attached to the rear portion of the rod. This tab allows for the break down of the rifle for cleaning by simply pressing the tab forward a short distance, which allows the rear of the break down tab to release itself from the lower receiver.

In embodiments, this system and method give a distinct advantage to mounted troops and aviation crews where a compact weapon is needed and this system allows for a folding or other type of non-fixed stock because there is no need for a recoil spring/buffer/buffer tube to be housed in the butt stock straight in-line with the barrel. This reduces overall length of the rifle, bringing the overall length of the rifle in embodiments down to around 22" with a 12" barrel.

It should be emphasized that the above-described embodiments of the present invention, particularly, any "preferred" embodiments, are merely possible examples of implementations, merely set forth for a clear understanding of the principles of the invention. Other systems, devices, methods, features, and advantages of the disclosed system and method include variations and modifications apparent or that may become apparent to one of skill in the art upon examination of the following figures and detailed description, without departing substantially from the spirit and principles of the invention. All such modifications and variations are intended to be included within this description and are intended to be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
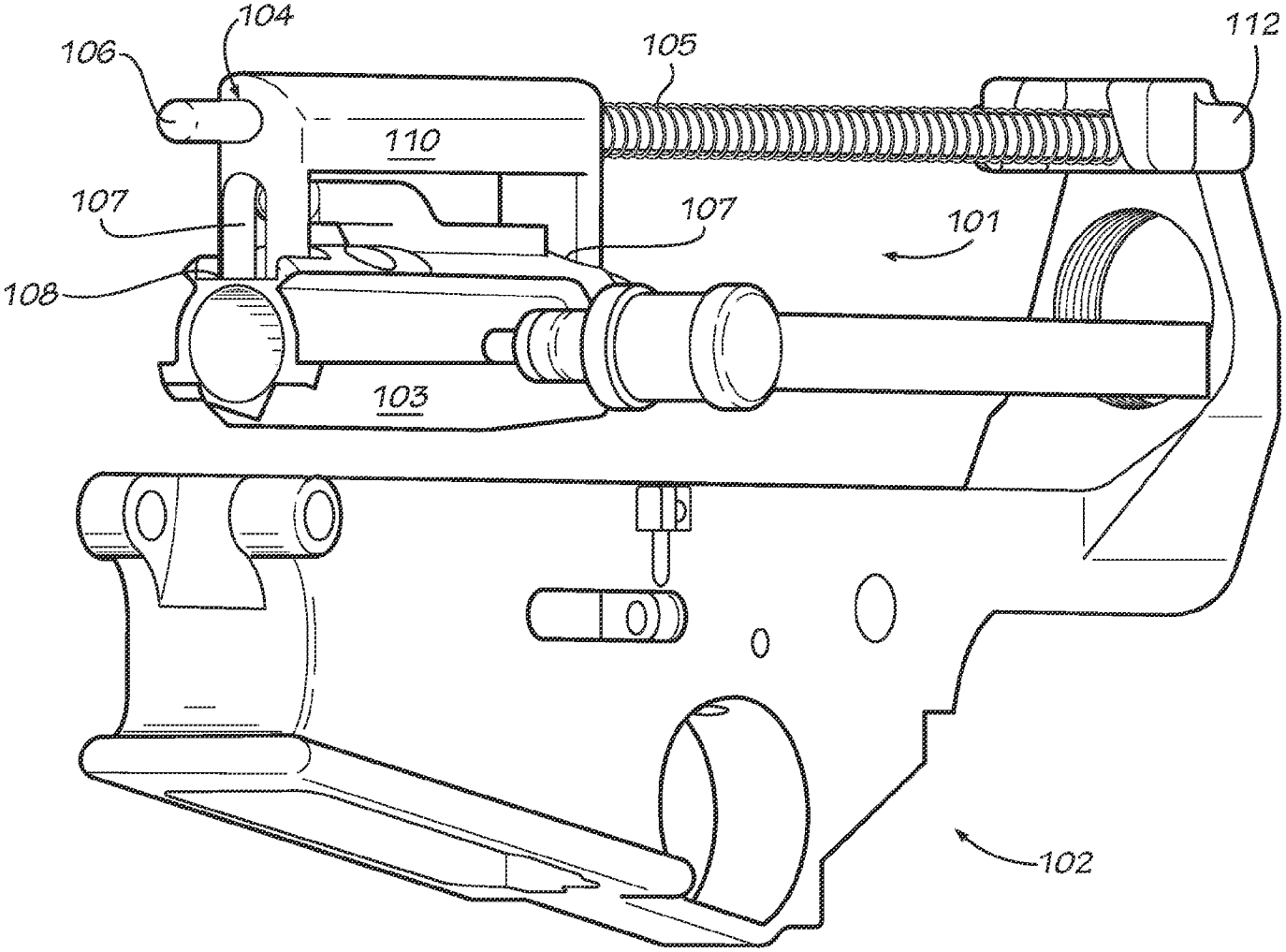
FIG. 1 is a perspective view of an upper receiver in accordance with one exemplary embodiment of the present invention.

Disclosed below are embodiments of a modular rifle system and method having a folding or non-fixed stock capability. FIG. 1 is a perspective view of an upper receiver assembly 101 along with a lower receiver assembly 102 in accordance with one exemplary embodiment of the present invention. Upper receiver 101 is releasably coupled to lower receiver 102. Upper receiver 101 contains a bolt carrier 103.

With reference to FIG. 1, upper receiver 101 contains a housing 110. Housing 110 encloses a recoil spring 105 and rod 106. Bolt carrier 103 contains integrated receptacle compartments in its top face, which allow housing 104 to be mounted on and rest upon bolt carrier 103 inside upper receiver 101. Within housing 110, recoil spring 105 rests against a counter bore shoulder. The front of housing 110 contains a hole 104 through which rod 106 protrudes, and upper receiver 101 also contains a hole through which rod 106 protrudes. In this embodiment, relocating the recoil spring and rod outside of the center line of the barrel allows for the M16-style rifle to have a folding or non-fixed stock. Further, containing the relocated recoil spring and rod within a housing in the described embodiment prevents the detrimental effects of heat transfer to the recoil spring from the direct gas operation of the typical M16-style modular rifle system.

Figure 2:
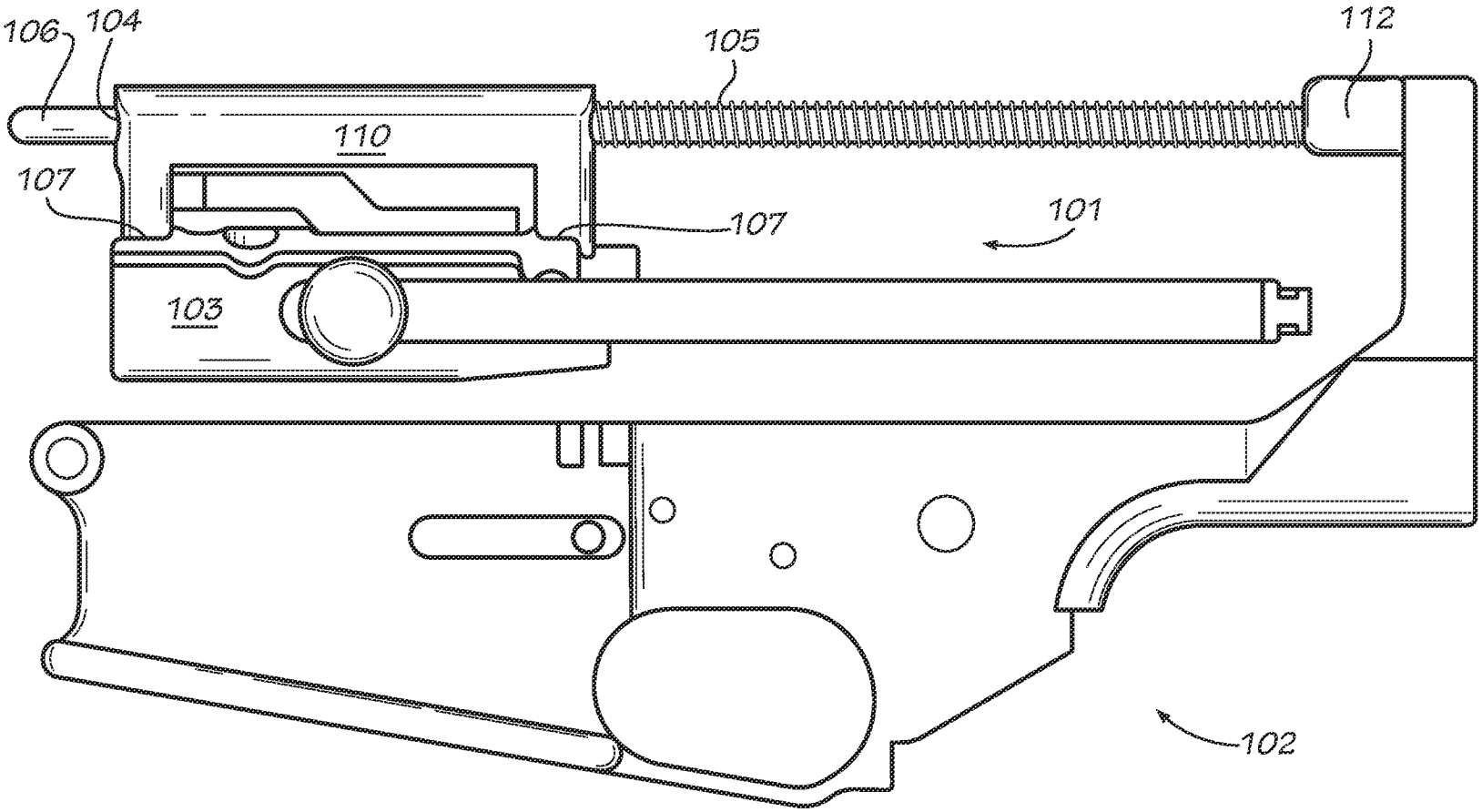
FIG. 2 is a side view of the upper receiver of FIG. 1.

With reference to FIG. 1, a retaining tab 112 is attached to rod 106, the depression of tab 112 allowing for the release of upper receiver 101 from lower receiver 102. FIG. 2 is a side view of upper receiver 101 and lower receiver 102, wherein upper receiver 101 is detachably coupled to lower receiver 102 and can be detached from lower receiver 102 by depression of tab 112. Pressing tab 112 forward a short distance releases lower receiver 102 from tab 112, thereby detaching upper receiver 101 from lower receiver 102. Uncoupling of upper receiver 101 from lower receiver 102 allows for the breakdown of the modular rifle system for easy cleaning, storage or mobility.

Figure 3:
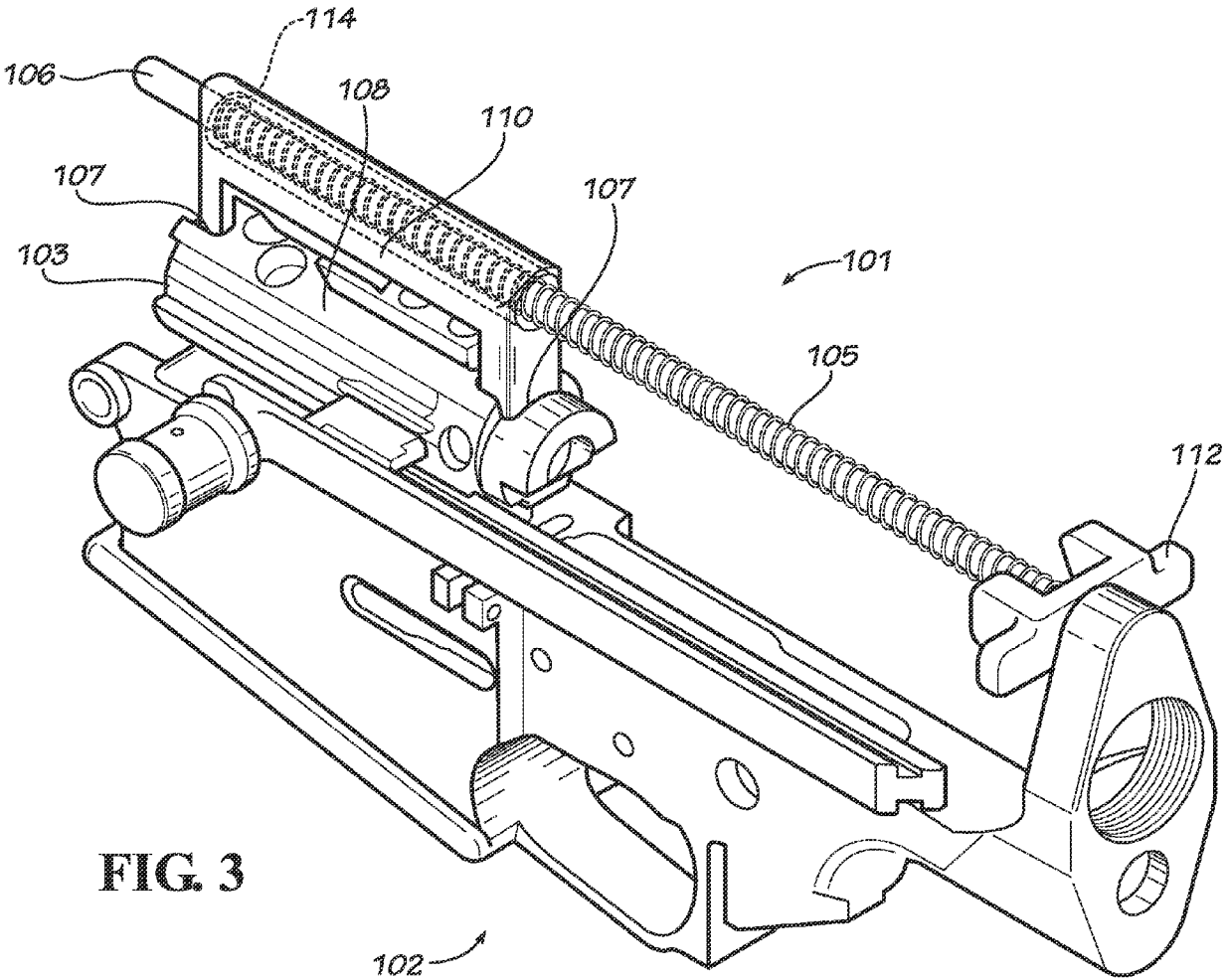
FIG. 3 is another perspective view of the upper receiver of FIGS. 1 and 2 from a different vantage point than that of FIG. 1.

FIG. 3 is another perspective view of the upper receiver of FIGS. 1 and 2 from a different vantage point than that of FIG. 1. With reference to FIG. 3, bolt carrier 103 contains integrated receptacle compartments 107 in its top face 108, which compartments allow housing 110 to be mounted on and rest upon bolt carrier 103 inside upper receiver 101.

Figure 4:
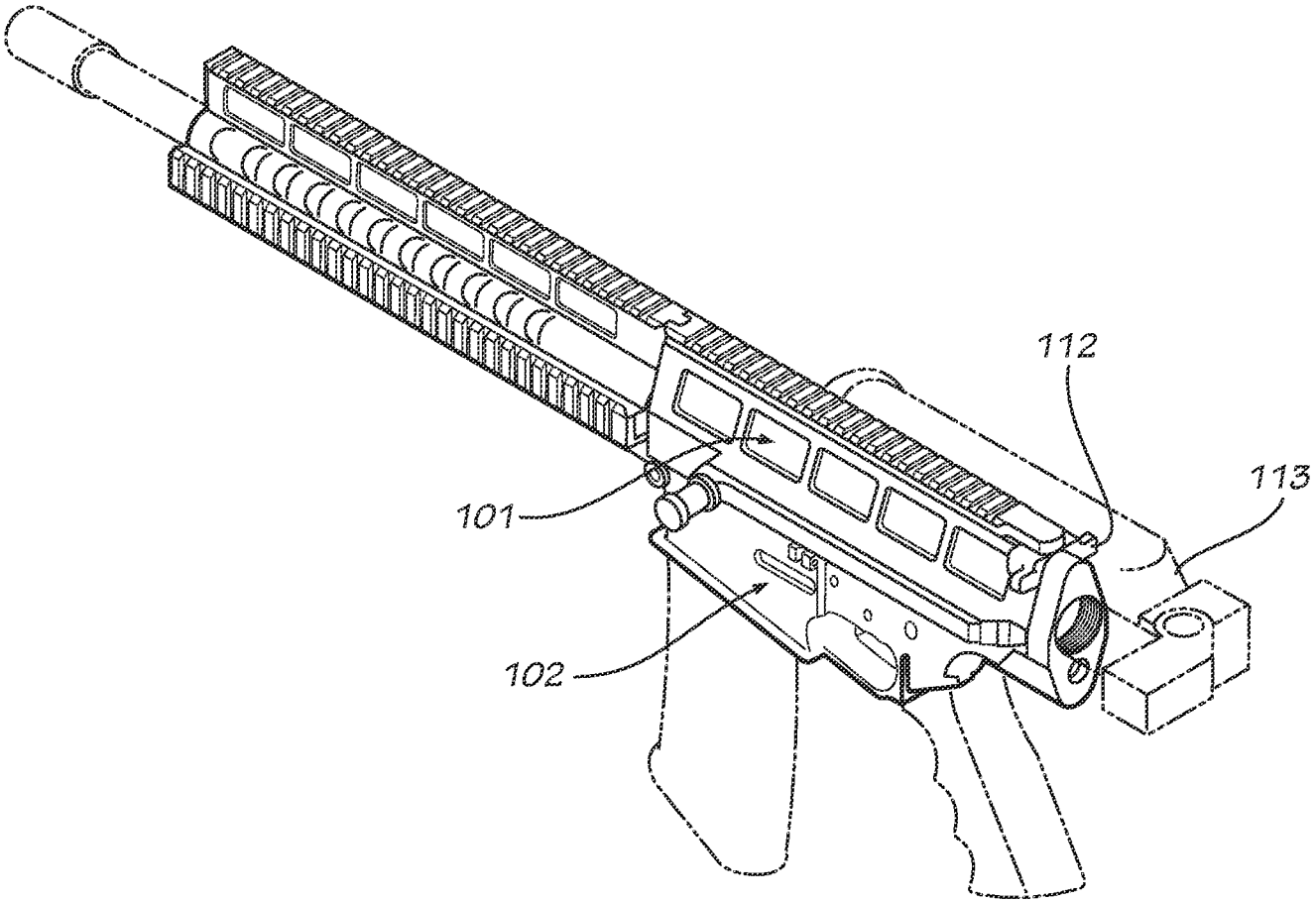
FIG. 4 is a perspective view of a rifle that incorporates the upper receiver of FIGS. 1-3. In accordance with the present invention, any of a number of possible collapsible style, folding, or non-fixed butts can be utilized in order to reduce the length of the rifle.

FIG. 4 is a perspective view of a modular rifle system that incorporates the upper receiver 101 and lower receiver 102 of FIGS. 1-3 with a folding, collapsible or non-fixed butt 113. In accordance with the present embodiment, any of a number of possible collapsible style butts can be utilized in order to reduce the length of the rifle to varying lengths, including but not limited to an overall rifle system length of approximately 22 inches or less with a barrel 114 measuring approximately 12 inches. The reduced length of the overall rifle system employing the recoil system and method contained in upper receiver 101 gives an operational advantage to mounted troops and aviation crews where a compact rifle system is needed due to constraints on movement and storage space.

In the embodiment illustrated in FIGS. 1-4, the modular rifle system is an M16-style rifle. For the purposes of this disclosure, the term "M16-style rifle" generally refers to the M16 automatic rifle commonly associated with the U.S. military and disclosed in U.S. Pat. No. 2,951,424, issued to Eugene M. Stoner on Sep. 6, 1960 (incorporated herein by reference in its entirety). The M16 rifle is a gas-operated rifle having a bolt and bolt carrier 103. Typically, the M16 is configured to fire .223 caliber rounds or other comparable rounds, such as 5.56×45 mm NATO rounds. The term "M16-style rifle" also refers to variants of the M16, which includes rifles sharing a commonality of parts with the M16 and rifles that are derived from the M16. One example variant of the M16 is the AR15 rifle, which is the semiautomatic civilian version of the M16. Other example variants of the M16 include rifles identified by the following appellations: XM16, XM16E1, M16A1, M16A2, M16A2E1, M16A2E2, M16A2E3, M16A2E4, M16A3, M16A4, XM177, XM177E1, XM177E2, CAR-15, M4 Carbine, M4A1 Carbine, M4E2, M4 MWS, Mk 4 Mod 0, M231, M231 FPW, KH2002, S5.56, MSSR, NORCINCO, M311/CQ, M14, M14 SMUD, GUU-5/P, Diemaco C7, Diemaco C8, SDM-R, SAM-R, Mark 11 SWS, Mark 12 SPR, SEAL Recon Rifle, Mark 18 CQBR, Ares Shrike, La France M16K, M249, XM8, MK16, FN SCAR Colt Commando, Colt Models 601, 602, 603, 604, 645, 645E, 646, 655, 656, 723, 725, 733, 920, 921, 921 HB, 925 and 945. The M16-style rifle also refers to the AR10/SR25 rifle system in 7.62 mm/.308 caliber. Still other variants of the M16 that are known now or are developed later are intended to be included within the scope of the term "M16-style rifle," as understood by a person of skill in the art.

While particular embodiments of modular rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. A direct gas impingement modular rifle system comprising:
- a lower receiver assembly;
- an upper receiver assembly containing a bolt carrier;
- a housing contained within the upper receiver assembly, the housing enclosing a recoil spring and a rod;
- wherein the housing is mounted on the bolt carrier, wherein a top face of the bolt carrier has integrated receptacle compartments, the integrated receptacle compartments allowing for the housing to rest upon the bolt carrier inside the upper receiver assembly; and
- wherein the housing contains:
  - a counter bore shoulder against which the recoil spring rests; and
  - a hole in the front of the housing through which the rod protrudes.

2. The direct gas impingement modular rifle system of claim 1, wherein the rifle system includes a folding stock.

3. The direct gas impingement modular rifle system of claim 2, further comprising:
- a retaining tab attached to the rod, wherein depressing the retaining tab releases the upper receiver assembly from the lower receiver assembly.

4. A modular rifle system comprising:
- a lower receiver assembly;
- an upper receiver assembly containing a bolt carrier, wherein a top face of the bolt carrier has integrated receptacle compartments;
- a housing contained within the upper receiver assembly, the housing enclosing a recoil spring and a rod, wherein the housing;
  - is mounted within the integrated receptacle compartments on the top face of the bolt carrier; and
  - contains a counter bore shoulder against which the recoil spring rests; and
  - contains a hole in the front of the housing allowing the rod to protrude from the upper receiver assembly; and
- a retaining tab attached to the rod, wherein depressing the retaining tab releases the upper receiver assembly from the lower receiver assembly.

5. The modular rifle system of claim 4, wherein the rifle system is of the type M16 or M4.

6. The modular rifle system of claim 4, wherein the rifle system is of the type AR10 or SR25.

7. The modular rifle system of claim 4, wherein the rifle system includes a folding stock.

8. A method of containing a recoil mechanism of a direct gas impingement modular rifle system within an upper receiver assembly containing a bolt carrier having a top face, comprising:
- mounting a housing on the bolt carrier;
- enclosing a recoil spring and a rod within the housing;
- containing the housing within the upper receiver assembly;
- connecting a lower receiver assembly to an upper receiver assembly containing the bolt carrier;

fashioning a hole in the front of the housing through which the rod protrudes; and creating a vertical planar surface within the housing surrounding the hole such that a shoulder is formed against which the recoil spring rests.

9. The method of claim 8, comprising:

integrating receptacle compartments into the top face of the bolt carrier; and mounting the housing on the bolt carrier by inserting the housing into the compartments.

10. The method of claim 9, further comprising:

attaching a retaining tab to the upper receiver assembly, wherein depressing the retaining tab releases the upper receiver assembly from the lower receiver assembly.

* * * * *